US011592182B1

(12) United States Patent
Rangrej et al.

(10) Patent No.: US 11,592,182 B1
(45) Date of Patent: Feb. 28, 2023

(54) SWIRLER FERRULE PLATE HAVING PRESSURE DROP PURGE PASSAGES

(71) Applicant: General Electric Company, Schenectady, NY (US)

(72) Inventors: Rimple Rangrej, Bengaluru (IN); Pradeep Naik, Bengaluru (IN); Perumallu Vukanti, Bengaluru (IN); Saket Singh, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/653,384

(22) Filed: Mar. 3, 2022

(30) Foreign Application Priority Data

Nov. 16, 2021 (IN) ..... 202111052552

(51) Int. Cl.
*F23R 3/58* (2006.01)
*F23R 3/26* (2006.01)

(52) U.S. Cl.
CPC . *F23R 3/58* (2013.01); *F23R 3/26* (2013.01)

(58) Field of Classification Search
CPC .... F23R 3/045; F23R 3/10; F23R 3/12; F23R 3/14; F23R 3/26; F23R 3/58
See application file for complete search history.

(56) References Cited

U.S. PATENT DOCUMENTS 5,941,075 A * 8/1999 Ansart ..... F23R 3/14 60/737
6,035,645 A 3/2000 Bensaadi et al.
6,834,505 B2 12/2004 Al-Roub et al.
7,013,649 B2 3/2006 Monty
7,104,066 B2 9/2006 Leen et al.
7,861,529 B2 1/2011 Commaret et al.
7,891,190 B2 2/2011 Commaret et al.
8,276,388 B2 * 10/2012 Cayre ..... F23R 3/14 60/741
10,801,726 B2 10/2020 Stevens et al.
2011/0271682 A1 * 11/2011 Sandelis ..... F23C 7/004 60/737

FOREIGN PATENT DOCUMENTS

CN 105716113 B 3/2019
EP 3417208 B1 8/2020

* cited by examiner

*Primary Examiner* — Steven M Sutherland
(74) *Attorney, Agent, or Firm* — Venable LLP; Edward A. Kmett; Michele V. Frank

(57) ABSTRACT

A swirler assembly of a combustor of a gas turbine, the swirler assembly including a primary swirler having a primary swirler flow opening, and a swirler ferrule plate connected to an upstream side of the primary swirler. The swirler ferrule plate includes (a) a fuel nozzle opening, and (b) a plurality of oxidizer purge passages surrounding the fuel nozzle opening, each one of the plurality of oxidizer purge passages including (i) an inlet passage portion, and (ii) an outlet passage portion extended from the inlet passage portion to a downstream end of the swirler ferrule plate and having an outlet in fluid communication with the primary swirler flow opening. The outlet passage portion has an increasing cross-sectional area extending along the length of the outer passage portion from the inlet passage portion to the outlet that induces a pressure drop in a flow of oxidizer through the oxidizer flow passage.

18 Claims, 11 Drawing Sheets

SWIRLER FERRULE PLATE HAVING PRESSURE DROP PURGE PASSAGES

CROSS REFERENCE TO RELATED APPLICATIONS

The present application claims the benefit of Indian Patent Application No. 202111052552, filed on Nov. 16, 2021, which is hereby incorporated by reference herein in its entirety.

TECHNICAL FIELD

The present disclosure relates to a swirler ferrule plate for a swirler assembly in a combustor of a gas turbine engine.

BACKGROUND

Some conventional gas turbine engines are known to include rich-burn combustors that typically use a swirler integrated with a fuel nozzle to deliver a swirled fuel/air mixture to a combustor. A radial-radial swirler is one example of such a swirler and includes a primary radial swirler, a secondary radial swirler, and a swirler ferrule plate surrounding a fuel nozzle. The primary swirler includes a primary swirler venturi in which a primary flow of swirled air from the primary swirler mixes with fuel injected into the primary swirler venturi by the fuel nozzle. The swirler ferrule plate may include constant height purge holes that provide a purge flow of air from a pressure plenum to the primary swirler venturi. The purge flow through the constant height purge holes of the swirler ferrule plate is at a relatively high velocity as it exits the swirler ferrule plate into the primary swirler venturi.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
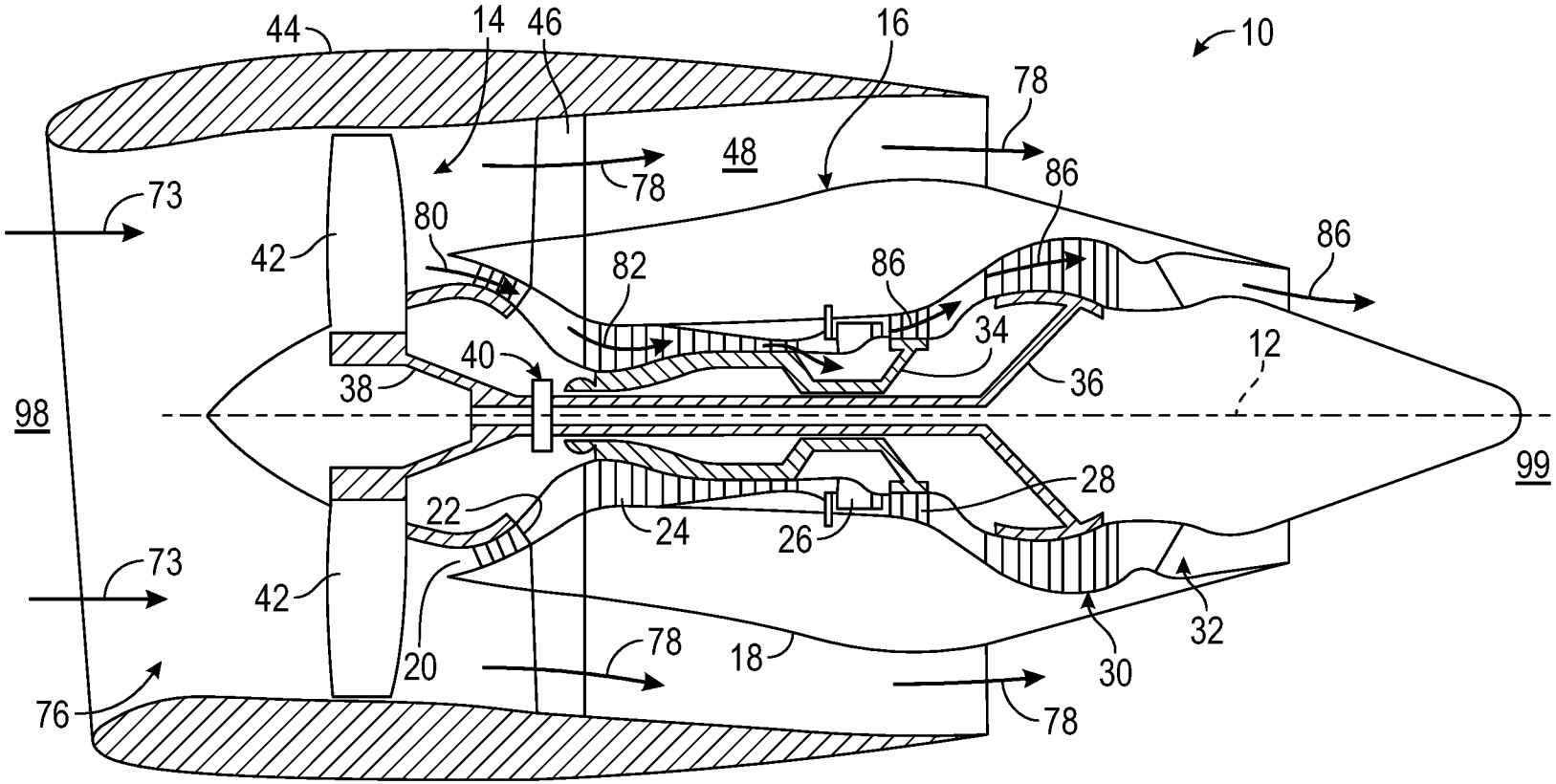
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a rich-burn combustor that includes, for example, a radial-radial swirler, air is provided from a pressure plenum of the combustor to a primary radial swirler, where a swirl is induced in the air by swirl vanes in a primary swirler as it flows through the primary swirler. The primary swirler also includes a venturi and a fuel nozzle injects fuel into the venturi, where it is mixed with the swirled air flow of the primary swirler. A swirler ferrule plate surrounds the fuel nozzle and may include constant height purge holes that provide a purge flow of air from the pressure plenum to the venturi. The purge flow through the constant height purge holes of the swirler ferrule plate is at a relatively high pressure and a high exit velocity as it exits the swirler ferrule plate into the primary swirler venturi. The high velocity air stream from the ferrule plate directly interacts with the swirled air from of the primary swirler, which causes hydrodynamic instabilities and introduces higher perturbation in the flow of the primary swirler, particularly before the fuel nozzle tip. These hydrodynamic instabilities drive instabilities in fuel distribution and heat release inside the combustor, leading to higher than desired amplitudes of pressure fluctuations inside the venturi.

The present disclosure addresses the foregoing to reduce the hydrodynamic instabilities and to keep the amplitudes of venturi pressure fluctuations at or below a desired level. According to the present disclosure, a swirler ferrule plate includes a plurality of oxidizer purge passages that are arranged to provide a pressure drop in the purge flow of the oxidizer through the swirler ferrule plate to the primary swirler. In some aspects, each of the plurality of oxidizer purge passages includes an outlet passage portion that has an increasing area along a length of the passage, such that a cross-sectional area of an outlet is greater than a cross-sectional area of an upstream side of the outlet passage portion at an inlet passage portion. In another aspect, the outlet passage portion of the oxidizer purge passage may include multiple branches that provide for an increase in cross-sectional area at the outlet as compared with the inlet of the outlet passage portion. In both aspects, the increased cross-sectional area induces a pressure drop in the flow of the oxidizer through the oxidizer purge passage so that a lower velocity is obtained at the outlet, thereby reducing the hydrodynamic instabilities and keeping the amplitudes of the venturi pressure fluctuations at or below a desired level.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section (22/24) having a booster or low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and extend radially outwardly from, the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
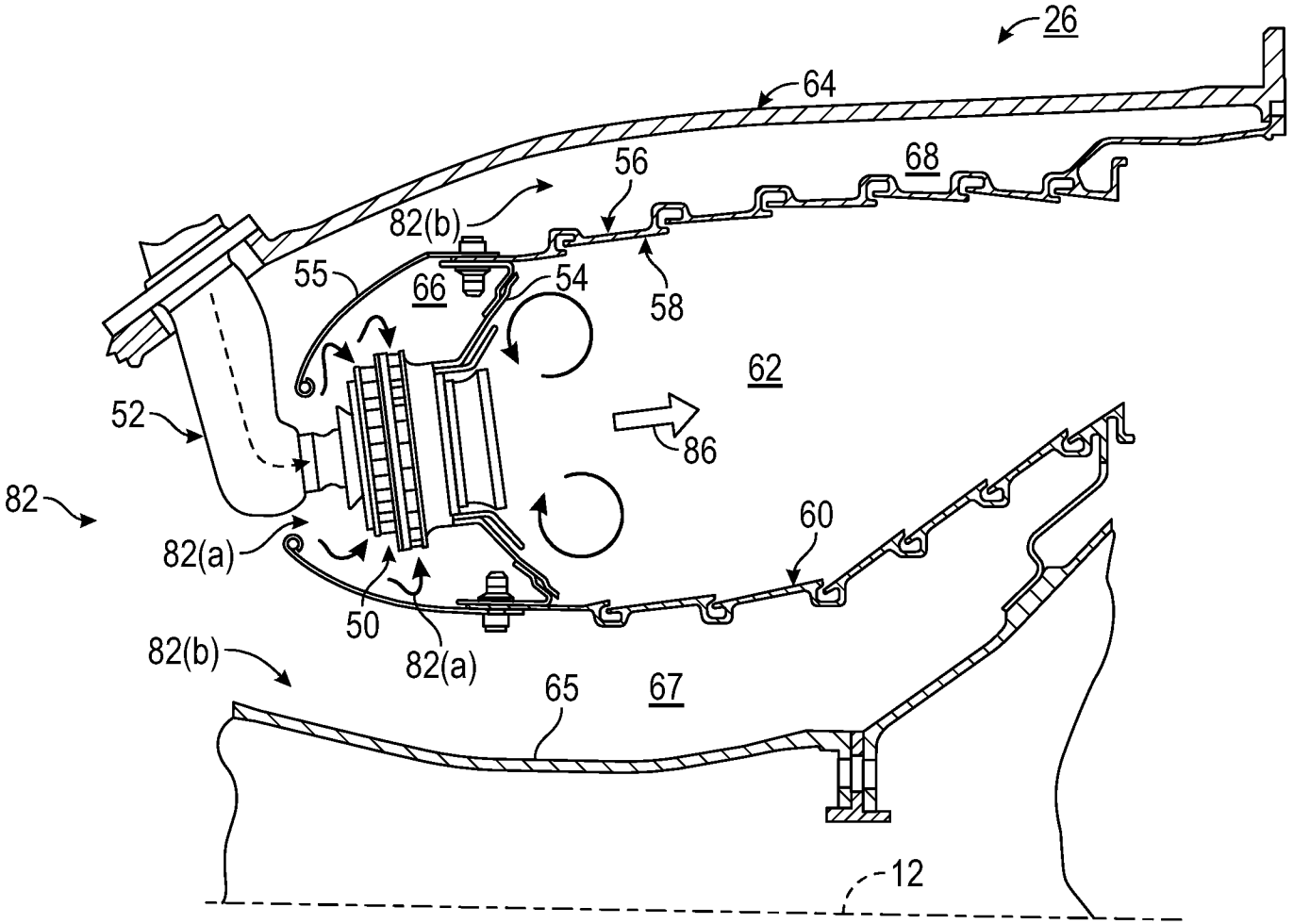
FIG. 2 is a partial cross-sectional side view of an exemplary combustion section, according to an aspect of the present disclosure.

FIG. 2 depicts an exemplary combustor 26 according to the present disclosure. In FIG. 2, combustor 26 includes a swirler assembly 50, a fuel nozzle assembly 52, a dome assembly 54, a cowl 55, and an annular combustion liner 56 within an outer casing 64 and an inner casing 65. The annular combustion liner 56 includes an annular outer liner 58 and an annular inner liner 60 forming a combustion chamber 62 therebetween. A pressure plenum 66 is formed within the cowl 55 and the dome assembly 54. Referring back to FIG. 1, in operation, air 73 enters the nacelle 44 at a nacelle inlet 76, and a portion of the air 73 enters the compressor section (22/24) as a compressor inlet air flow 80, where it is compressed. Another portion of the air 73 enters the bypass airflow passage 48 as a bypass airflow 78. In FIG. 2, compressed air 82 from the compressor section (22/24) enters the combustor 26 via a diffuser (not shown). A portion of the compressed air 82(*a*) enters the cowl 55 to the pressure plenum 66, while another portion of the compressed air 82(*b*) passes to an outer flow passage 68 between the annular outer liner 58 and the outer casing 64, and to an inner flow passage 67 between the annular inner liner 60 and the inner casing 65. As will be described below, compressed air 82(*a*) in the pressure plenum 66 passes through the swirler assembly 50 to mix with fuel injected by the fuel nozzle assembly 52 into the swirler assembly 50. A swirled fuel and air mixture (not shown) injected from the swirler assembly 50 into the combustion chamber 62 is then ignited and burned to generate combustion product gases 86 within the combustion chamber 62.

Figure 3:
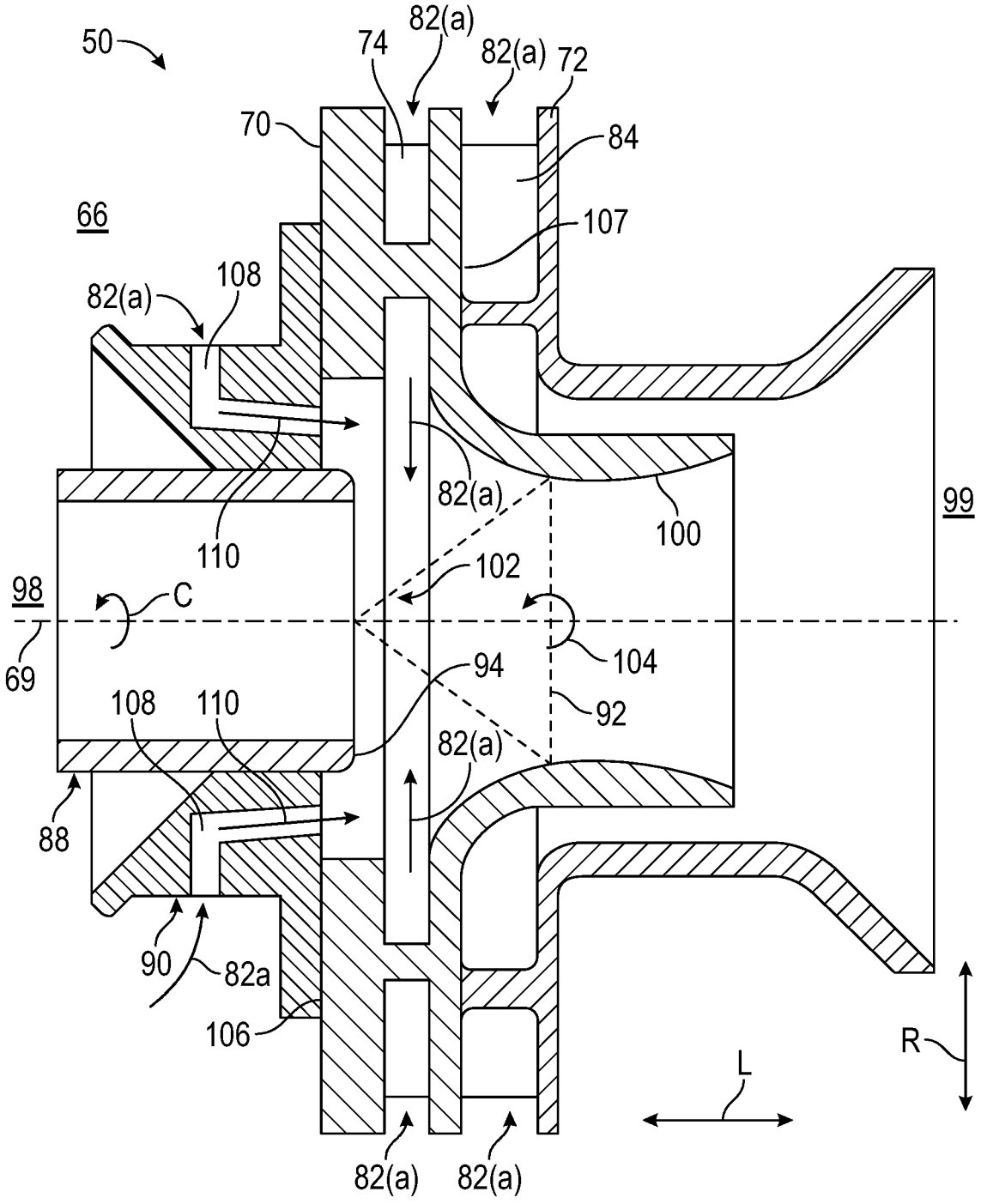
FIG. 3 is a partial cross-sectional side view of the swirler assembly, according to an aspect of the present disclosure.

FIG. 3 is a partial cross-sectional side view of the swirler assembly 50. The swirler assembly 50 defines a swirler centerline 69 that extends in a longitudinal direction (L), a radial direction (R) that extends outward from the swirler centerline 69, and a circumferential direction (C) that extends circumferentially about the swirler centerline 69. The swirler assembly 50 is symmetrical about the swirler centerline 69, and, as shown in FIG. 2, is suitably connected to dome assembly 54. The swirler assembly 50 includes a primary swirler 70, a secondary swirler 72, and a swirler ferrule plate 90. The primary swirler 70 includes a plurality of primary swirler swirl vanes 74 and a primary swirler venturi 100. The primary swirler swirl vanes 74 are circumferentially disposed in a row such that each of the primary swirler swirl vanes 74 extends radially inward to provide a radial swirled flow of an oxidizer (e.g., compressed air 82(*a*)) to a primary swirler flow opening 102 that extends through the primary swirler 70. The primary swirler 70 also includes the primary swirler venturi 100 that extends in the longitudinal direction (L) from a downstream side 107 of the primary swirler 70, and also extends circumferentially about swirler centerline 69. Thus, the primary swirler 70 is configured for swirling a corresponding portion of the compressed air 82(*a*) from the pressure plenum 66 radially inward from the plurality of primary swirler swirl vanes 74, and then, in a primary swirler swirl direction 104 within the primary swirler 70 (i.e., either clockwise about swirler centerline 69, or counter-clockwise about swirler centerline 69).

The secondary swirler 72 similarly includes secondary swirler swirl vanes 84 that are circumferentially disposed in a row such that each of the secondary swirler swirl vanes 84 extends radially inward. Thus, the secondary swirler 72 is configured for swirling another corresponding portion of the compressed air 82(*a*) from the pressure plenum 66 radially inward from the plurality of secondary swirler swirl vanes 84 of secondary swirler 72.

The fuel nozzle assembly 52 is seen to include a fuel nozzle 88 disposed within the swirler ferrule plate 90 of the swirler assembly 50. The fuel nozzle 88 injects a fuel 92 from a fuel nozzle tip 94 through the primary swirler flow opening 102 into the primary swirler venturi 100, where the fuel 92 is mixed with the swirled compressed air 82(*a*) from primary swirler 70. The fuel and air mixture (not shown) in the venturi further mixes with the swirled compressed air 82(*a*) from secondary swirler 72 downstream of the primary swirler venturi 100.

In FIG. 3, swirler ferrule plate 90 interfaces with primary swirler 70 at an upstream side 106 of the primary swirler 70. Various structural embodiments of the swirler ferrule plate 90 will be discussed in more detail below. Briefly, swirler ferrule plate 90 includes a plurality of oxidizer purge passages 108. The plurality of oxidizer purge passages 108 provide fluid communication between the pressure plenum 66 and the primary swirler flow opening 102 such that, a portion of the compressed air 82(*a*) in the pressure plenum 66 flows through the oxidizer purge passages 108 to provide a purge airflow, also referred to herein as a flow of oxidizer, 110 to the primary swirler flow opening 102. The purge airflow 110 incurs a pressure drop when passing through the oxidizer purge passages 108, such that a pressure of the purge airflow 110 is less than a pressure of the compressed air 82(*a*) in the pressure plenum 66. That is, in operation, the compressed air 82(*a*) in the pressure plenum 66 is pressurized at a first pressure $P_1$ due to the compression of the air by the compressor section (22/24), and, within each of the plurality of oxidizer purge passages 108, the compressed air 82(*a*) incurs a pressure drop $\Delta P$ from the first pressure $P_1$ to a second pressure $P_2$ that is lower than the first pressure $P_1$. As will be described below, a geometry of each of the oxidizer purge passages 108 provides the pressure drop of the purge airflow 110.

Figure 4:
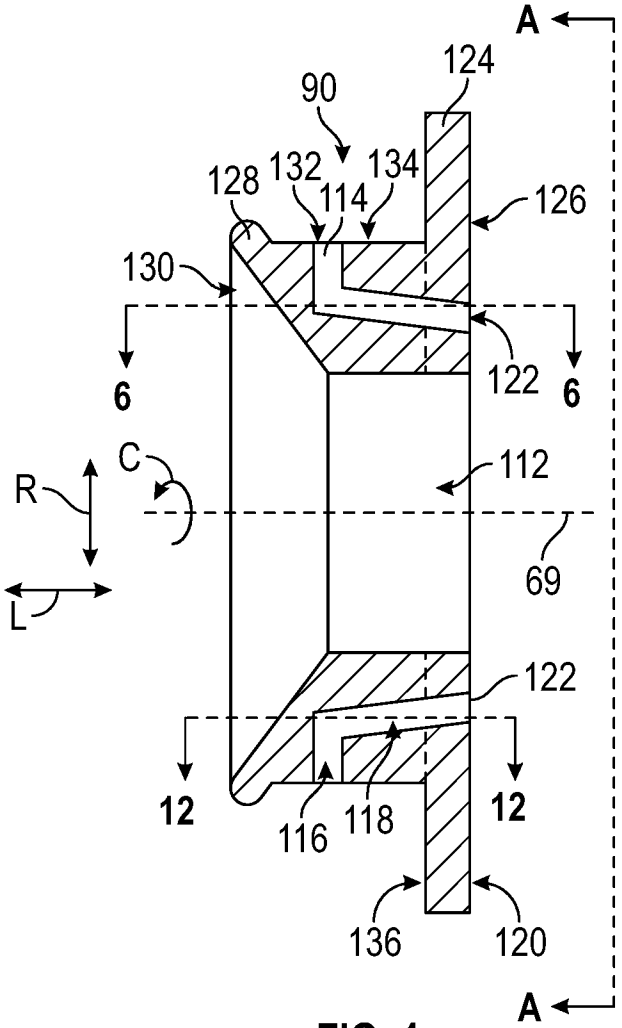
FIG. 4 is a cross-sectional side view of a swirler ferrule plate, according to an aspect of the present disclosure.
Figure 9:
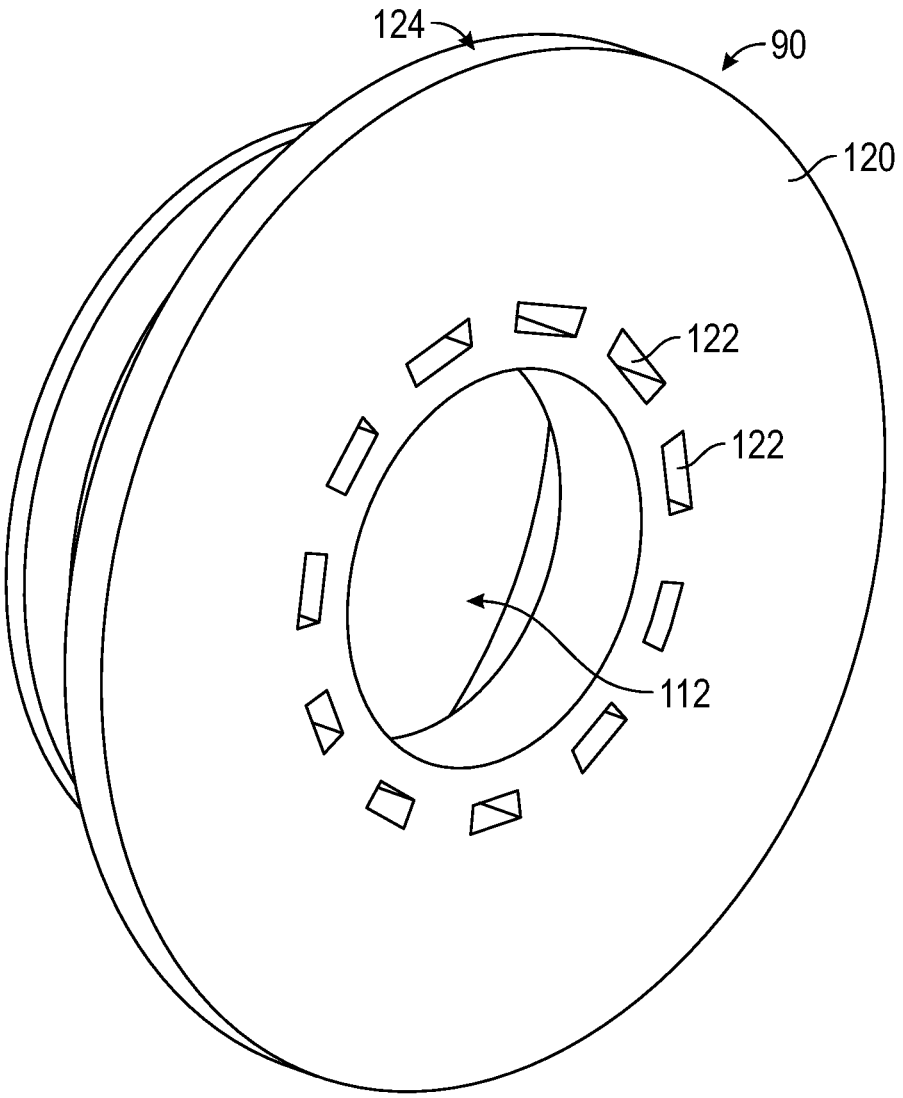
FIG. 9 is an aft forward-looking perspective view of a swirler ferrule plate, according to another aspect of the present disclosure.

FIG. 4 is a cross-sectional side view of a swirler ferrule plate 90, according to an aspect of the present disclosure. In FIG. 4, the swirler ferrule plate 90 is seen to include a fuel nozzle opening 112 extended therethrough in the longitudinal direction (L) and extending circumferentially about the swirler centerline 69. The swirler ferrule plate 90 also includes a plurality of oxidizer purge passages 114 surrounding the fuel nozzle opening 112. For example, referring to FIG. 5, which is taken at view A-A shown in FIG. 4, the plurality of oxidizer purge passages 114, each having an outlet 122, may be circumferentially spaced about the fuel nozzle opening 112 so as to surround the fuel nozzle opening 112, and may be spaced a same radial distance 150 from the swirler centerline 69. FIG. 9 is an aft forward-looking perspective view of a swirler ferrule plate 90 that also depicts the outlets 122 circumferentially spaced about the fuel nozzle opening 112. In FIG. 4, each of the plurality of oxidizer purge passages 114 includes an inlet passage portion 116, and an outlet passage portion 118 that extends from the inlet passage portion 116 to a downstream surface 120 of the swirler ferrule plate 90. Each one of the plurality of oxidizer purge passages 114 includes the outlet 122 that extends through the downstream surface 120 and is in fluid communication with the primary swirler flow opening 102. As will be described in more detail below, the inlet passage portion 116 provides a pressure drop in the flow of oxidizer 110 passing through the inlet passage portion 116, and the outlet passage portion 118 has a cross-sectional area extending along the length of the outlet passage portion 118 from the inlet passage portion 116 to the outlet 122 that induces a further pressure drop in the flow of oxidizer 110 through the oxidizer purge passage 114.

The swirler ferrule plate 90 is seen to include an annular radial wall 124 at a downstream end 126 of the swirler ferrule plate 90 that extends in the circumferential direction (C) about the swirler centerline 69. The swirler ferrule plate 90 also includes an annular axial wall 128 extending in the longitudinal direction (L) toward an upstream end 130 of the swirler ferrule plate 90 from the annular radial wall 124, and extending circumferentially about the swirler centerline 69. The fuel nozzle opening 112 extends through the ferrule plate 90 in the longitudinal direction (L) along the swirler centerline 69 through the annular radial wall 124 and through the annular axial wall 128. The inlet passage portion 116 extends in the radial direction (R) and includes an inlet 132 at a radially outer surface 134 of the annular axial wall 128. The inlet 132 is arranged, in the longitudinal direction (L) along the length of the annular axial wall 128, between the upstream end 130 and an upstream side 136 of the annular radial wall 124. The location of the inlet 132 to the inlet passage portion 116 along the length of the annular axial wall 128 can be varied, depending on the length of the outlet passage portion 118 and a desired amount of pressure drop to be achieved.

Figure 6:
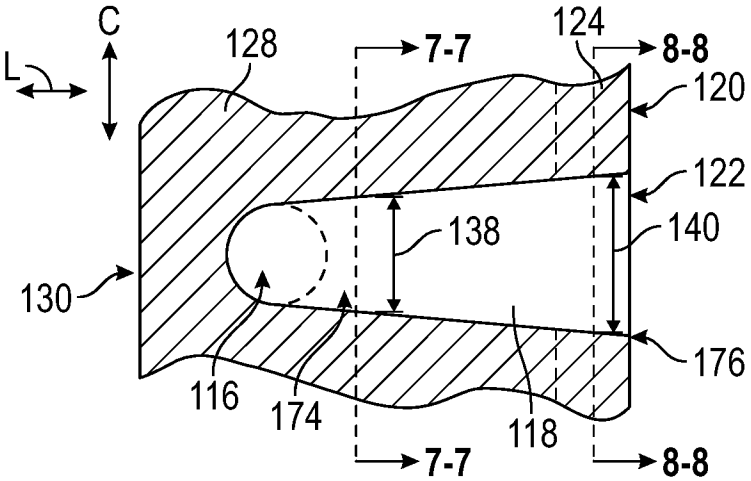
FIG. 6 is a partial cross-sectional view of an oxidizer purge passage taken at plane 6-6 of FIG. 4, according to an aspect of the present disclosure.

Referring now to FIGS. 6 to 10, an arrangement of the oxidizer purge passage 114 according to one aspect of the present disclosure will be described. FIG. 6 is a partial cross-sectional view taken at plane 6-6 of FIG. 4. As shown in FIG. 6, the inlet passage portion 116 may be a cylindrical shaped port, having a cylindrical cross section, that, as was described above, extends in the radial direction. On the other hand, the outlet passage portion 118 extends in the longitudinal direction (L) from the inlet passage portion 116 to the outlet 122 through the downstream surface 120 of the annular radial wall 124, and may have a generally trapezoidal shape as seen in the cross section of FIG. 6. For example, an upstream width 138 of the outlet passage portion 118 taken at plane 7-7 may be less than a downstream width 140 of the outlet passage portion 118 taken at plane 8-8.

Figure 7:
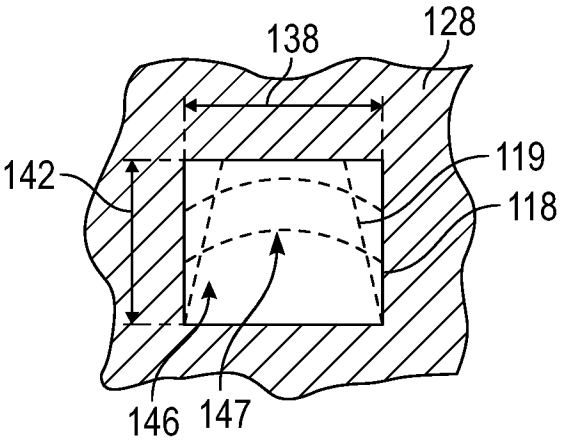
FIG. 7 is a cross-sectional view of an outlet passage portion taken at plane 7-7 in FIG. 6, according to an aspect of the present disclosure.
Figure 8:
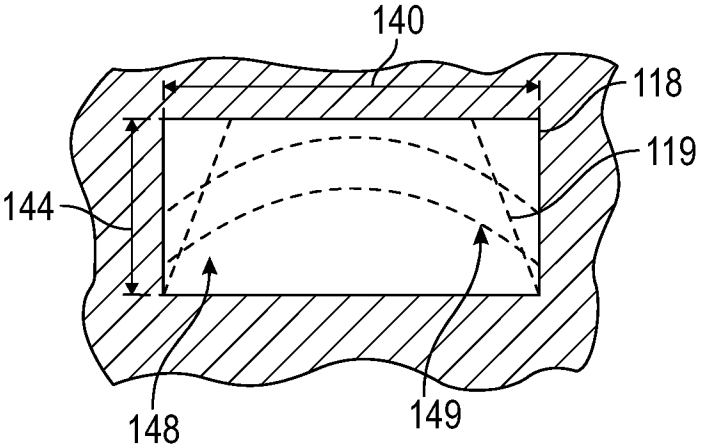
FIG. 8 is a cross-sectional view of an outlet passage portion taken at plane 8-8 in FIG. 6, according to an aspect of the present disclosure.

FIG. 7 is a cross-sectional view taken at plane 7-7 of the outlet passage portion 118 in FIG. 6, and FIG. 8 is a cross section taken at plane 8-8 of the outlet passage portion 118 in FIG. 6. As seen in FIGS. 7 and 8, a cross-sectional area of the outlet passage portion 118 may be generally rectangular shaped. In this case, an upstream height 142 of the outlet passage portion 118 at plane 7-7 may be less than a downstream height 144 of the outlet passage portion taken at plane 8-8. Thus, the outlet passage portion 118 includes a first cross-sectional area 146 at plane 7-7 near the inlet passage portion 116, and may have a second cross-sectional area 148 that is greater than the first cross-sectional area 146, near the outlet 122. That is, the outlet passage portion 118 has an increasing cross-sectional area along the length of the outlet passage portion 118 from the inlet passage portion 116 to the outlet 122. Of course, the downstream height 144 may be the same as the upstream height 142 such that a constant height is implemented along the longitudinal length of the outlet passage portion 118, but the upstream width 138 may nonetheless be less than the downstream width 140 such that an increasing cross-sectional area along the length of the outlet passage portion 118 is still provided. In addition, while a generally rectangular-shaped outlet passage portion 118 is shown in FIGS. 7 and 8, other cross section shapes, such as a trapezoidal shaped passage 119, a triangular shaped passage, an elliptical shaped passage, or a racetrack shaped passage, may be implemented instead.

Figure 10:
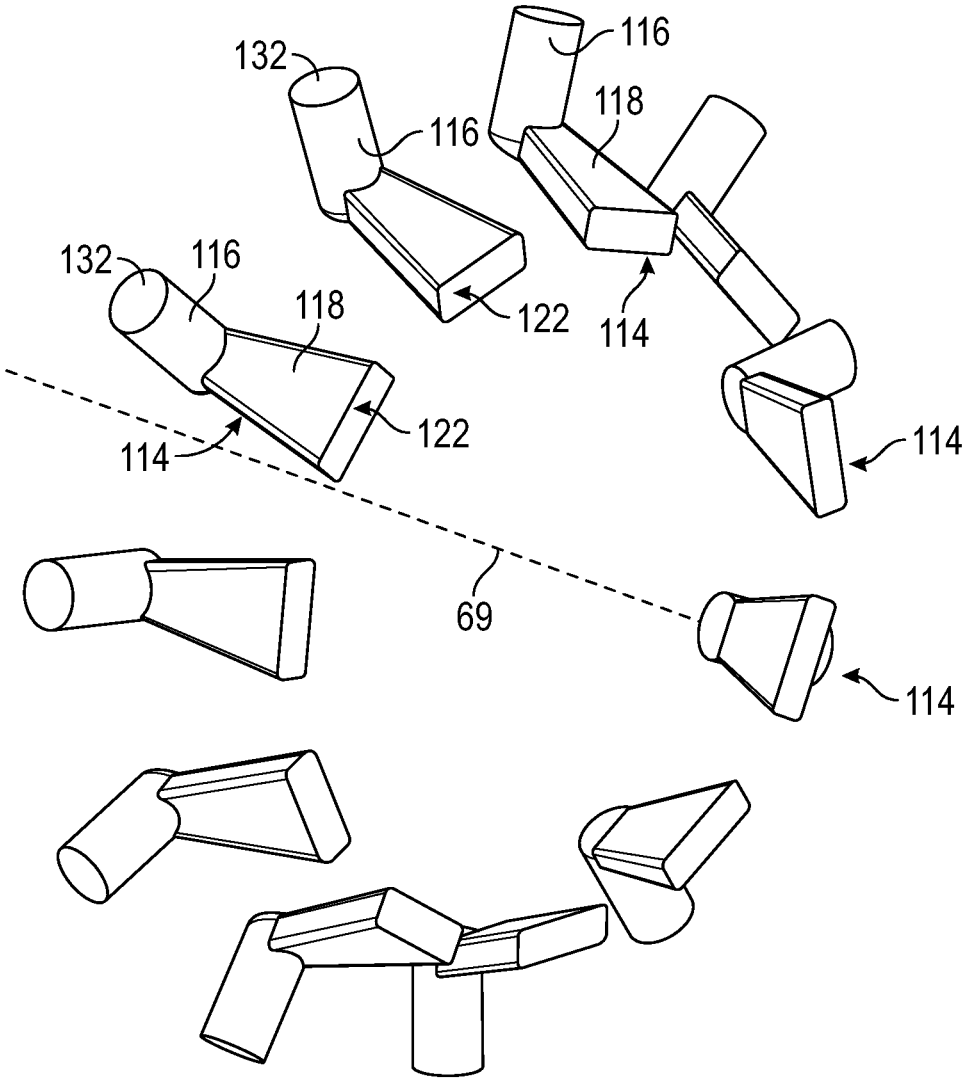
FIG. 10 depicts an example of a plurality of oxidizer purge passages, with the swirl ferrule plate not shown, according to another aspect of the present disclosure.

FIG. 10 depicts an example of a plurality of oxidizer purge passages 114, with the swirler ferrule plate 90 not shown. As was discussed above, each of the plurality of oxidizer purge passages 114 includes the inlet passage portion 116 that extends in the radial direction (R) with respect to the swirler centerline 69, and is generally cylindrical shaped. Each of the plurality of oxidizer purge passages 114 also includes the outlet passage portion 118 that is shown as being a generally trapezoidal shaped passage as shown in FIG. 6, and includes the rectangular cross section as shown in FIGS. 7 and 8. With the plurality of oxidizer purge passages 114 being provided as shown, the flow of oxidizer 110 through the oxidizer purge passage 114 incurs a pressure drop while passing through the inlet passage portion 116, and a further pressure drop when passing through the outlet passage portion 118, from the first pressure $P_1$ at the inlet 132 of the inlet passage portion 116 to the second pressure $P_2$ at the outlet 122. Here, the inlet passage portion 116 may provide for a higher drop in the pressure than a remaining pressure drop that is incurred in the outlet passage portion 118.

Figure 5:
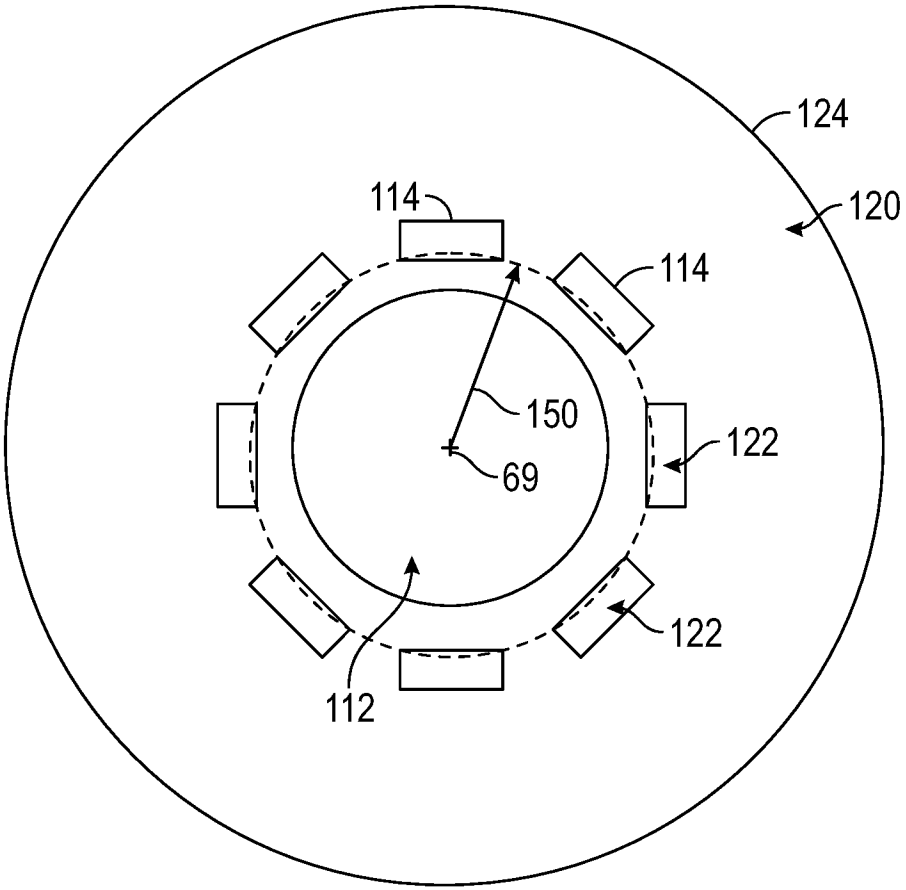
FIG. 5 is an aft forward-looking elevational view taken at A-A shown in FIG. 4, according to an aspect of the present disclosure.
Figure 11:
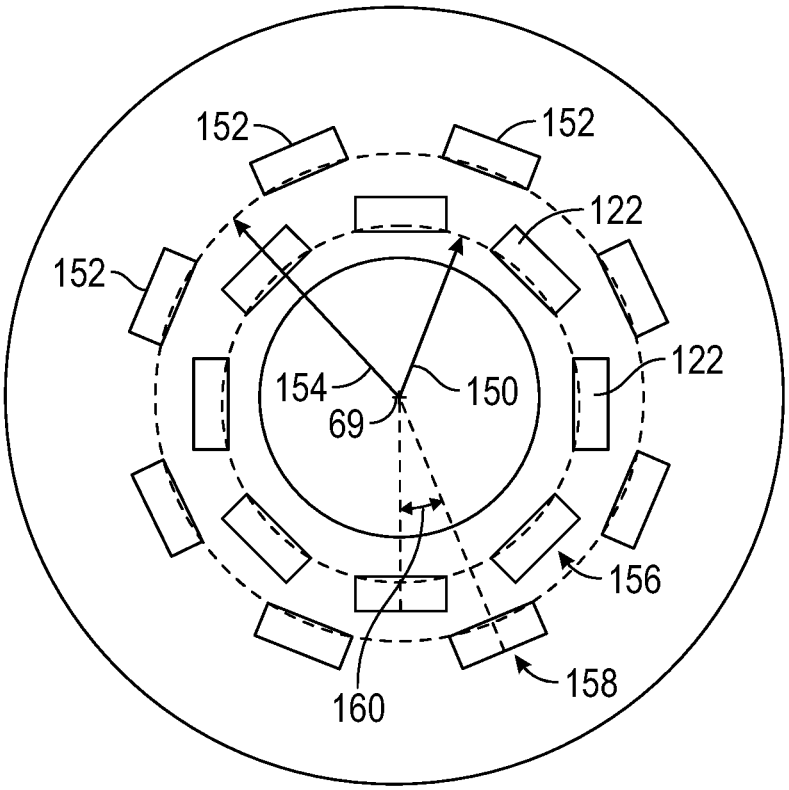
FIG. 11 is an aft forward-looking elevational view depicting another arrangement of outlets for a plurality of oxidizer flow passages taken at view A-A of FIG. 4, according to yet another aspect of the present disclosure.

FIG. 11, which is taken at view A-A of FIG. 4, depicts another arrangement of outlets for a plurality of oxidizer flow passages, according to another aspect of the present disclosure. In FIG. 5, the outlets 122 of each of the plurality of oxidizer purge passages 114 were shown as being arranged circumferentially about the swirler centerline 69 a same radial distance 150. In FIG. 11, the plurality of oxidizer purge passages 114 having the outlets 122 arranged at the same radial distance 150, also referred to herein as a first radial distance, are included and may be referred to as a first group 156 of oxidizer purge passages 114. In FIG. 11, however, a second group 158 of the plurality of oxidizer purge passages 114 having an outlet 152 may be included. The outlet 152 may be same as the outlet 122, but each outlet 152 of each of the plurality of oxidizer purge passages 114 of the second group 158 is arranged at a second radial distance 154 different from the radial distance 150 from the swirler centerline 69. In addition, each outlet 152 may be circumferentially offset from the outlets 122 an offset angle 160.

Figure 12:
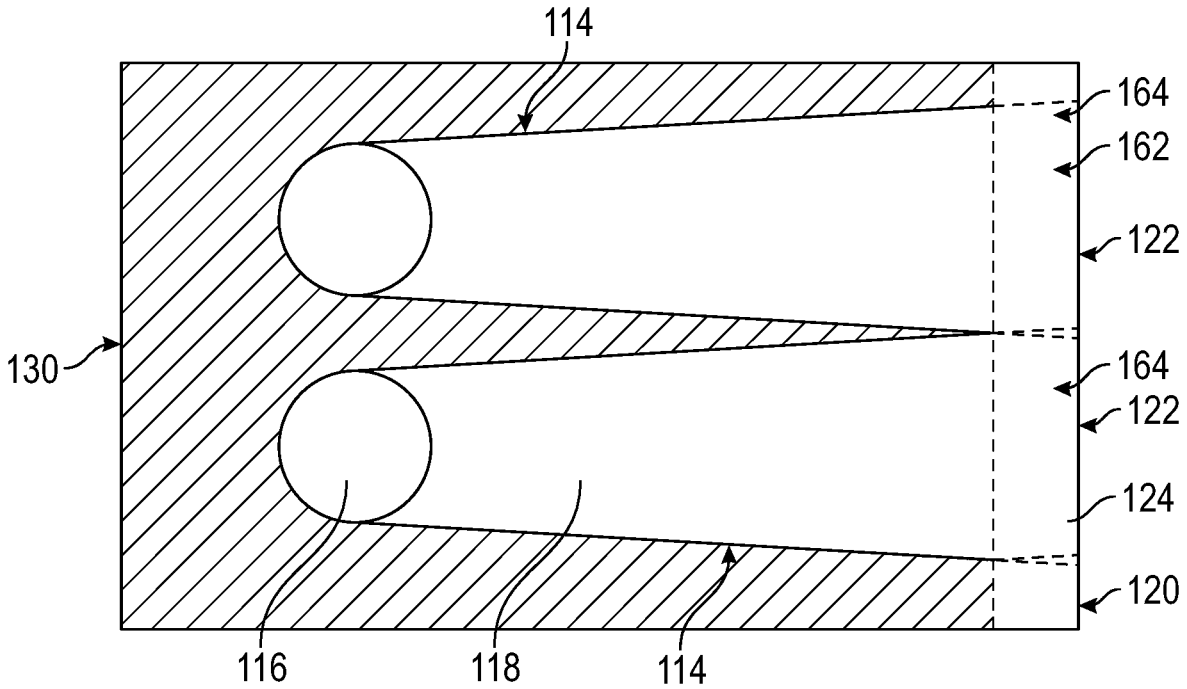
FIG. 12 is a partial cross-sectional view taken at plane 12-12 of FIG. 4, depicting another arrangement of oxidizer purge passages according to yet another aspect of the present disclosure.
Figure 13:
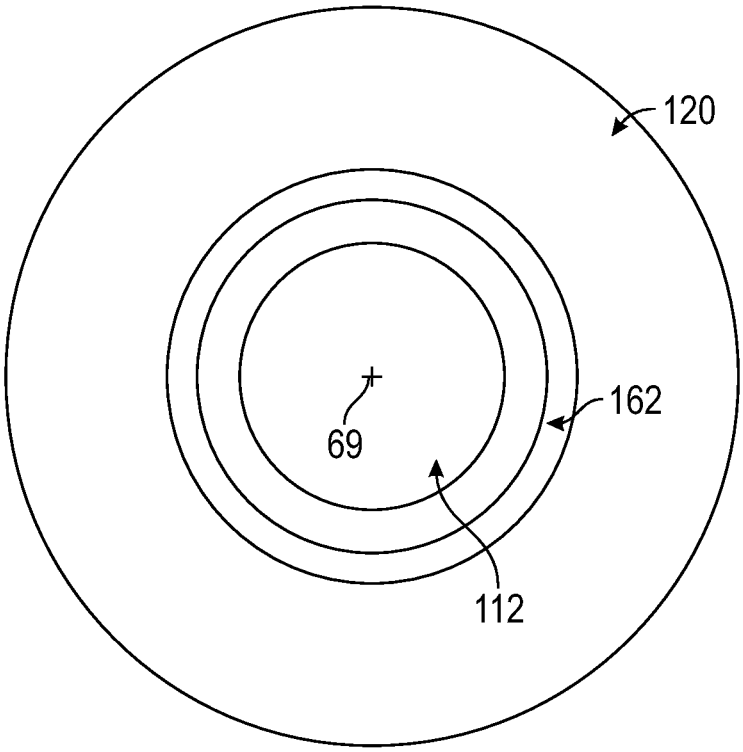
FIG. 13 is an aft forward-looking elevational view depicting an arrangement of an annular outlet for a plurality of oxidizer flow passages taken at view A-A of FIG. 4, according to yet another aspect of the present disclosure.

FIG. 12 is a partial cross-sectional view taken at plane 12-12 of FIG. 4, depicting another arrangement of oxidizer purge passages according to yet another aspect of the present disclosure. In FIG. 12, each of the oxidizer purge passages 114 is arranged circumferentially so that an outlet end portion 164 of each of the oxidizer purge passages 114 merge together circumferentially. Thus, the outlets 122 of the plurality of oxidizer purge passages 114 are merged to define an annular outlet 162 extending circumferentially about the swirler centerline 69 through the downstream surface 120 of the annular radial wall 124. FIG. 13, which is taken at view A-A of FIG. 4, depicts an aft forward-looking view of the swirler ferrule plate 90 having the annular outlet 162.

Figure 14:
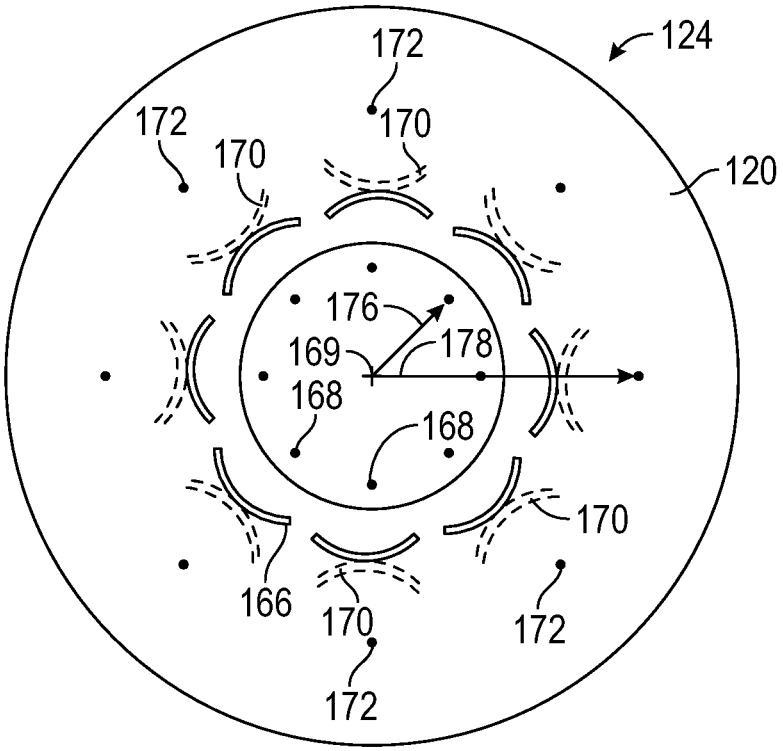
FIG. 14 is an aft forward-looking elevational view depicting another arrangement of outlets for a plurality of oxidizer flow passages taken at view A-A of FIG. 4, according to yet another aspect of the present disclosure.

FIG. 14, which is taken at view A-A of FIG. 4, depicts another arrangement of outlets of the oxidizer purge passages, according to still yet another aspect of the present disclosure. In FIG. 14, the outlet passage portion 118 (FIG. 4) has an arc-shaped cross section 147, 149 (FIGS. 7 and 8) and includes an arc-shaped outlet 166. In the same manner as the rectangular shaped cross section of FIGS. 5 to 8, an area of the arc-shaped cross section 147 of the arc-shaped outlet passage portion 118 at an upstream end 174 (FIG. 6) is less than an area of the arc-shaped cross section 149 at the arc-shaped outlet 166. In FIG. 14, the arc-shaped outlet 166 may be implemented such that a center 168 of the arc-shaped outlet 166 is arranged radially inward, with respect to the swirler centerline 69, of the arc-shaped outlet 166. A radial distance 176 of the center 168 may be set based on a desired flow pattern of the oxidizer exiting the arc-shaped outlet 166 into the primary swirler flow opening 102. Alternatively, an arc-shaped outlet 170 may be implemented, where a center 172 of the arc-shaped outlet 170 is arranged radially outward, with respect to the swirler centerline 69, of the arc-shaped outlet 170. A radial distance 178 of the center 172 may be set based on a desired flow pattern of the oxidizer exiting the arc-shaped outlet 170 into the primary swirler flow opening 102.

Figure 15:
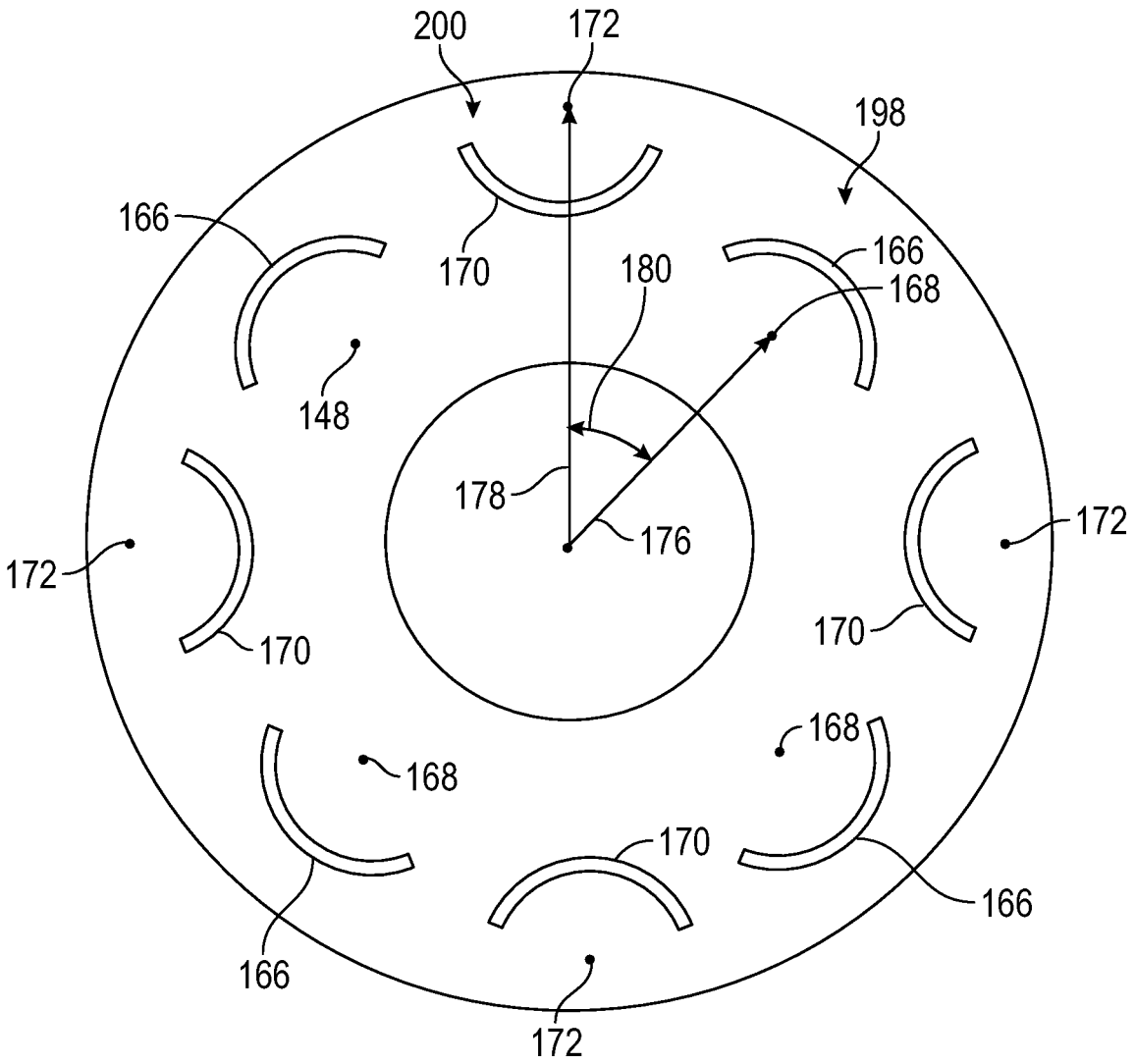
FIG. 15 is an aft forward-looking elevational view depicting another arrangement of outlets for a plurality of oxidizer flow passages taken at view A-A of FIG. 4, according to yet another aspect of the present disclosure.

FIG. 15, which is taken at view A-A of FIG. 4, depicts another arrangement of outlets of the oxidizer purge passages, according to still yet another aspect of the present disclosure. The FIG. 15 aspect incorporates both the arc-shaped outlets 166 and the arc-shaped outlets 170 in a circumferential alternating arrangement about the swirler centerline 69. Thus, each of the arc-shaped outlets 166 for corresponding arc-shaped oxidizer outlet passage portions 118 may be considered to be a first group 198, and each of the arc-shaped outlets 170 for corresponding arc-shaped oxidizer outlet passage portions 118 may be considered to be a second group 200. The arc-shaped outlet 166 of each of the plurality of arc-shaped outlet passage portions 118 among the first group 198 has the center 168 arranged radially inward of the arc-shaped outlet 166 with respect to the swirler centerline 69. The arc-shaped outlet 170 of each of the plurality of arc-shaped outlet passage portions 118 among the second group 200 of arc-shaped outlet passage portions 118 has the center 172 arranged radially outward of the arc-shaped outlet 170 with respect to the swirler centerline 69. In a similar manner as that of FIG. 14, the radial distance 176 to the center 168 of the arc-shaped outlet 166, and the radial distance 178 to the center 172 of the arc-shaped outlet 170 may be set based on a desired amount, or pattern, of flow of the oxidizer to be provided to the primary swirler flow opening 102. In FIG. 15, in implementing the alternating arrangement, an offset angle 180 is implemented between the center 168 of the arc-shaped outlet 166 and the center 172 of the arc-shaped outlet 170. The offset angle 180 may be, for example, forty-five degrees, as shown in FIG. 15. However, the offset angle 180 may be set based on the number of the arc-shaped outlets 166 and the arc-shaped outlets 170 that are implemented in a particular arrangement.

Figure 16:
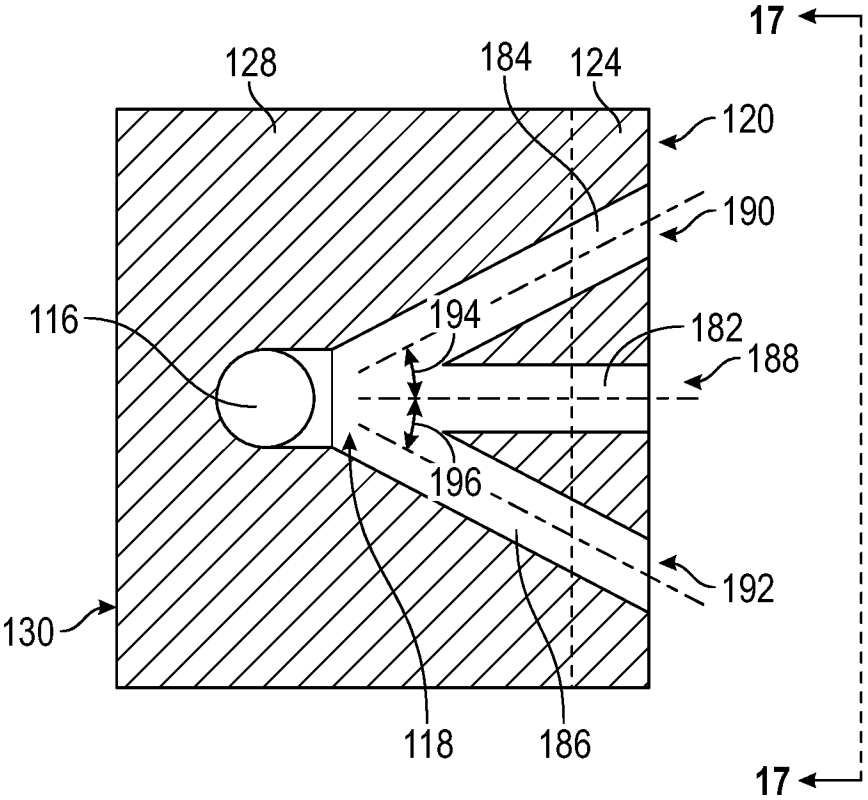
FIG. 16 is a partial cross-sectional view, taken at plane 6-6 of FIG. 4, depicting another arrangement of an oxidizer purge passage, according to still another aspect of the present disclosure.

FIG. 16 is a partial cross-sectional view, taken at plane 6-6 of FIG. 4, depicting another arrangement of the oxidizer purge passage 114, according to still another aspect of the present disclosure. In the FIG. 16 aspect, the outlet passage portion 118 is branched to include multiple branched passages. For example, the outlet passage portion 118 may include a first branched outlet passage 182 having a first branched outlet passage outlet 188 at the downstream surface 120 of the annular radial wall 124. The outlet passage portion 118 may further include a second branched outlet passage 184, that may be arranged at a branch angle 194 with respect to the first branched outlet passage 182, and that includes a second branched outlet passage outlet 190 at the downstream surface 120 of the annular radial wall 124. Further, the outlet passage portion 118 may include a third branched outlet passage 186, that may be arranged at a branch angle 196 with respect to the first branched outlet passage 182, and that includes a third branched outlet passage outlet 192 at the downstream surface 120 of the annular radial wall 124. Each branch 182, 184, 186 of the plurality of branched outlet passages may have a constant cross-sectional area along the length of the respective branch, or may have an increasing cross-sectional area along the length of the respective branch, such as the increasing cross-sectional area described with regard to FIG. 6 above. The multiple branches 182, 184, 186 of the outlet passage portion 118 provide for the increased area downstream of the inlet passage portion 116 so as to provide for the desired pressure drop from the first pressure $P_1$ to the second pressure $P_2$ at the first branched outlet passage outlet 188, the second branched outlet passage outlet 190, and the third branched outlet passage outlet 192.

Figure 17A:
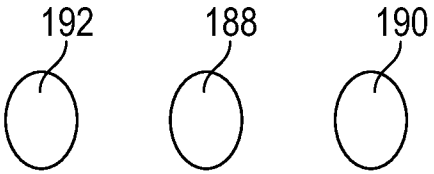
FIGS. 17(*a*) to 17(*c*) depict various views of outlets taken at view 17-17 of FIG. 16, according to an aspect of the present disclosure.
Figure 17B:
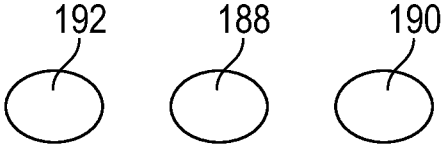
Figure 17C:
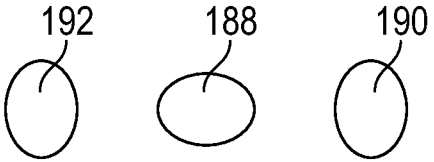

Each of the first branched outlet passage 182, the second branched outlet passage 184, and the third branched outlet passage 186 may include the same or different cross-sectional shape, such as a circular cross-sectional shape, an oval cross-sectional shape, a trapezoidal cross-sectional shape, etc. FIGS. 17(*a*) to 17(*c*), which are taken at view 17-17 of FIG. 16, depict various arrangements of the outlets 188, 190 and 192, for a case when an oval cross-sectional shape is implemented. In the arrangement of FIG. 17(*a*), each of first branched outlet passage outlet 188, the second branched outlet passage outlet 190, and the third branched outlet passage outlet 192 is seen to be oriented in a same vertically aligned arrangement. In FIG. 17(*b*), each of the first branched outlet passage outlet 188, the second branched outlet passage outlet 190, and the third branched outlet passage outlet 192 is seen to be oriented in a same horizontally aligned arrangement. In FIG. 17(*c*), the first branched outlet passage outlet 188 is seen to be oriented in a horizontally aligned arrangement, while the second branched outlet passage outlet 190 and the third branched outlet passage outlet 192 are seen to be oriented in a vertically aligned arrangement. Thus, the orientation of the outlets may be varied and set based on a desired flow of the oxidizer into the primary swirler flow opening 102.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A swirler assembly of a combustor of a gas turbine, the swirler assembly comprising: a primary swirler having a primary swirler flow opening therethrough; and a swirler ferrule plate connected to an upstream side of the primary swirler and including (a) a fuel nozzle opening extended therethrough, and (b) a plurality of oxidizer purge passages surrounding the fuel nozzle opening, each one of the plurality of oxidizer purge passages including (i) an inlet passage portion, and (ii) an outlet passage portion extended from the inlet passage portion to a downstream surface of the swirler ferrule plate and having an outlet in fluid communication with the primary swirler flow opening, the outlet passage portion having a cross-sectional area extending along a length of the outlet passage portion from the inlet passage portion to the outlet that induces a pressure drop in a flow of oxidizer through the oxidizer purge passage.

The swirler assembly according to any preceding clause, wherein the flow of oxidizer through the oxidizer purge passage incurs the pressure drop from a first pressure at an inlet of the inlet passage portion to a second pressure at the outlet at the primary swirler flow opening.

The swirler assembly according to any preceding clause, wherein the swirler assembly defines a swirler centerline extended therethrough, a longitudinal direction extending along the swirler centerline, a radial direction extending outward from the swirler centerline, and a circumferential direction extending about the swirler centerline, the swirler ferrule plate comprises an annular radial wall at a downstream end of the swirler ferrule plate and extending in the circumferential direction about the swirler centerline, and an annular axial wall extending in the longitudinal direction toward an upstream end of the swirler ferrule plate from the annular radial wall, and extending circumferentially about the swirler centerline, the fuel nozzle opening extending in the longitudinal direction along the swirler centerline through the annular radial wall and through the annular axial wall.

The swirler assembly according to any preceding clause, wherein the primary swirler comprises a venturi arranged at a downstream side of the primary swirler and extending downstream in the longitudinal direction from the downstream side of the primary swirler, and the swirler assembly further comprises a secondary swirler connected to the downstream side of the primary swirler.

The swirler assembly according to any preceding clause, wherein the inlet passage portion extends in the radial direction and includes an inlet at a radially outer surface of the annular axial wall, the inlet being arranged in the longitudinal direction between an upstream end of the annular axial wall and an upstream side of the annular radial wall.

The swirler assembly according to any preceding clause, wherein the outlet passage portion extends in the longitudinal direction and the outlet extends through the downstream surface of the swirler ferrule plate.

The swirler assembly according to any preceding clause, wherein an outlet end portion of each of the plurality of oxidizer purge passages merge together circumferentially so that the outlet of each of the plurality of oxidizer purge passages is merged to define an annular outlet extending circumferentially about the swirler centerline through the downstream surface of the swirler ferrule plate.

The swirler assembly according to any preceding clause, wherein the outlet passage portion includes an increasing cross-sectional area along the length of the outlet passage portion from the inlet passage portion to the outlet.

The swirler assembly according to any preceding clause, wherein the outlet passage portion has a trapezoidal cross section, an area of the trapezoidal cross section at an upstream end of the outlet passage portion being less than an area of the trapezoidal cross section at the outlet.

The swirler assembly according to any preceding clause, wherein the inlet passage portion has a cylindrical cross section.

The swirler assembly according to any preceding clause, wherein the outlet of each of the plurality of oxidizer purge passages is arranged about the swirler centerline a same radial distance from the swirler centerline.

The swirler assembly according to any preceding clause, wherein the plurality of oxidizer purge passages comprises a first group of oxidizer purge passages and a second group of oxidizer purge passages.

The swirler assembly according to any preceding clause, wherein the outlet of each of the plurality of oxidizer purge passages of the first group of oxidizer purge passages is arranged at a first radial distance from the swirler centerline, and the outlet of each of the plurality of oxidizer purge passages of the second group of oxidizer purge passages is arranged at a second radial distance different from the first radial distance from the swirler centerline.

The swirler assembly according to any preceding clause, wherein the outlet passage portion has a arc-shaped cross section, an area of the arc-shaped cross section at an upstream end of the outlet passage portion being less than an area of the arc-shaped cross section at the outlet.

The swirler assembly according to any preceding clause, wherein the plurality of oxidizer purge passages comprises a first group of oxidizer purge passages and a second group of oxidizer purge passages, the outlet of each of the plurality of oxidizer purge passages among the first group of oxidizer purge passages having an arc center arranged radially inward of the outlet with respect to the swirler centerline, and the outlet of each of the plurality of oxidizer purge passages among the second group of oxidizer purge passages having an arc center arranged radially outward of the outlet with respect to the swirler centerline.

The swirler assembly according to any preceding clause, wherein respective ones of the plurality of oxidizer purge passages of the first group of oxidizer purge passages and respective ones of the plurality of oxidizer purge passages of the second group of oxidizer purge passages are disposed in an alternate arrangement circumferentially about the swirler centerline.

The swirler assembly according to any preceding clause, wherein the outlet passage portion comprises a plurality of branched outlet passage portions, each branch of the plurality of branched outlet passage portions having a respective outlet at the downstream surface of the swirler ferrule plate.

The swirler assembly according to any preceding clause, wherein each branch of the plurality of branched outlet passage portions has a constant cross-sectional area along the length of the respective branch.

The swirler assembly according to any preceding clause, wherein each branch of the plurality of branched outlet passage portions has an increasing cross-sectional area along the length of the respective branch.

The swirler assembly according to any preceding clause, wherein the respective outlets of each branch of the branched outlet passage portions are arranged in a same orientation circumferentially about the swirler centerline, or the respective outlets of each branch of the branched outlet passage portions are arranged in a different orientation circumferentially about the swirler centerline.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A swirler assembly of a combustor of a gas turbine, the swirler assembly defining a swirler centerline extended therethrough, a longitudinal direction extending along the swirler centerline, a radial direction extending outward from the swirler centerline, and a circumferential direction extending about the swirler centerline, the swirler assembly comprising:

a primary swirler having a primary swirler flow opening therethrough; and a swirler ferrule plate connected to an upstream side of the primary swirler and including (a) a fuel nozzle opening extended therethrough, and (b) a plurality of oxidizer purge passages surrounding the fuel nozzle opening, each one of the plurality of oxidizer purge passages including (i) an inlet passage portion extending in the radial direction, and (ii) an outlet passage portion extending in the longitudinal direction from the inlet passage portion through a downstream surface of the swirler ferrule plate and having an outlet in fluid communication with the primary swirler flow opening, the outlet passage portion having an increasing cross-sectional area extending along a length of the outlet passage portion from the inlet passage portion to the outlet that induces a pressure drop in a flow of oxidizer through the oxidizer purge passage.

2. The swirler assembly according to claim 1, wherein the flow of oxidizer through the oxidizer purge passage incurs the pressure drop from a first pressure at an inlet of the inlet passage portion to a second pressure at the outlet at the primary swirler flow opening.

3. The swirler assembly according to claim 1, wherein the swirler ferrule plate comprises an annular radial wall at a downstream end of the swirler ferrule plate and extending in the circumferential direction about the swirler centerline, and an annular axial wall extending in the longitudinal direction toward an upstream end of the swirler ferrule plate from the annular radial wall, and extending circumferentially about the swirler centerline, the fuel nozzle opening extending in the longitudinal direction along the swirler centerline through the annular radial wall and through the annular axial wall.

4. The swirler assembly according to claim 3, wherein the primary swirler comprises a venturi arranged at a downstream side of the primary swirler and extending downstream in the longitudinal direction from the downstream side of the primary swirler, and the swirler assembly further comprises a secondary swirler connected to the downstream side of the primary swirler.

5. The swirler assembly according to claim 3, wherein the inlet passage portion includes an inlet at a radially outer surface of the annular axial wall, the inlet being arranged in the longitudinal direction between an upstream end of the annular axial wall and an upstream side of the annular radial wall.

6. The swirler assembly according to claim 1, wherein an outlet end portion of each of the plurality of oxidizer purge passages merge together circumferentially so that the outlet of each of the plurality of oxidizer purge passages is merged to define an annular outlet extending circumferentially about the swirler centerline through the downstream surface of the swirler ferrule plate.

7. The swirler assembly according to claim 1, wherein the outlet passage portion has a trapezoidal cross section, an area of the trapezoidal cross section at an upstream end of the outlet passage portion being less than an area of the trapezoidal cross section at the outlet.

8. The swirler assembly according to claim 1, wherein the inlet passage portion has a cylindrical cross section.

9. The swirler assembly according to claim 1, wherein the outlet of each of the plurality of oxidizer purge passages is arranged about the swirler centerline a same radial distance from the swirler centerline.

10. The swirler assembly according to claim 1, wherein the plurality of oxidizer purge passages comprises a first group of oxidizer purge passages and a second group of oxidizer purge passages.

11. The swirler assembly according to claim 10, wherein the outlet of each of the plurality of oxidizer purge passages of the first group of oxidizer purge passages is arranged at a first radial distance from the swirler centerline, and the outlet of each of the plurality of oxidizer purge passages of the second group of oxidizer purge passages is arranged at a second radial distance different from the first radial distance from the swirler centerline.

12. The swirler assembly according to claim 1, wherein the outlet passage portion has an arc-shaped cross section, an area of the arc-shaped cross section at an upstream end of the outlet passage portion being less than an area of the arc-shaped cross section at the outlet.

13. The swirler assembly according to claim 12, wherein the plurality of oxidizer purge passages comprises a first group of oxidizer purge passages and a second group of oxidizer purge passages, the outlet of each of the plurality of oxidizer purge passages among the first group of oxidizer purge passages having an arc center arranged radially inward of the outlet with respect to the swirler centerline, and the outlet of each of the plurality of oxidizer purge passages among the second group of oxidizer purge passages having an arc center arranged radially outward of the outlet with respect to the swirler centerline.

14. The swirler assembly according to claim 12, wherein respective ones of the plurality of oxidizer purge passages of the first group of oxidizer purge passages and respective ones of the plurality of oxidizer purge passages of the second group of oxidizer purge passages are disposed in an alternate arrangement circumferentially about the swirler centerline.

15. The swirler assembly according to claim 1, wherein the outlet passage portion comprises a plurality of branched outlet passage portions, each branch of the plurality of branched outlet passage portions having a respective outlet at the downstream surface of the swirler ferrule plate.

16. The swirler assembly according to claim 15, wherein each branch of the plurality of branched outlet passage portions has a constant cross-sectional area along the length of the respective branch.

17. The swirler assembly according to claim 15, wherein each branch of the plurality of branched outlet passage portions has an increasing cross-sectional area along the length of the respective branch.

18. The swirler assembly according to claim 15, wherein the respective outlets of each branch of the branched outlet passage portions are arranged in a same orientation circumferentially about the swirler centerline, or the respective outlets of each branch of the branched outlet passage portions are arranged in a different orientation circumferentially about the swirler centerline.

* * * * *